US009565935B2

(12) United States Patent
Kubiniec

(10) Patent No.: US 9,565,935 B2
(45) **Date of Patent: *Feb. 14, 2017**

(54) WEAPON STOCK SADDLE FOR A MASS WEAPON STORAGE SYSTEM

(71) Applicant: Thomas Kubiniec, Cazenovia, NY (US)

(72) Inventor: Thomas Kubiniec, Cazenovia, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/088,333

(22) Filed: Apr. 1, 2016

(65) Prior Publication Data

US 2016/0213144 A1 Jul. 28, 2016

Related U.S. Application Data

(63) Continuation of application No. 14/533,806, filed on Nov. 5, 2014, now Pat. No. 9,345,323.

(51) Int. Cl.

| | |
|---|---|
| ***A47F 7/00*** | (2006.01) |
| ***B60R 7/14*** | (2006.01) |
| ***A47B 81/00*** | (2006.01) |
| ***A47B 96/02*** | (2006.01) |
| ***F41A 23/18*** | (2006.01) |

(52) U.S. Cl.

CPC ..... *A47B 81/005* (2013.01); *A47B 96/027* (2013.01); *A47F 7/0021* (2013.01); *A47F 7/0028* (2013.01); *A47F 7/0035* (2013.01); *F41A 23/18* (2013.01)

(58) Field of Classification Search

CPC .... A47F 7/0028; A47F 7/0021; A47F 7/0035; A47F 7/00; B60R 7/14; Y10S 211/01

USPC . 211/64–66, 113, 70.2, 70.8, 60.1; 248/201, 248/693; 42/85

See application file for complete search history.

(56) References Cited

U.S. PATENT DOCUMENTS

| | | | | | |
|---|---|---|---|---|---|
| 554,252 | A * | 2/1896 | Falk | F41A 23/18 | 211/64 |
| 4,936,531 | A * | 6/1990 | Bauser | B60N 3/00 | 211/64 |
| 4,986,427 | A * | 1/1991 | Law | A47B 81/005 | 211/117 |
| 5,794,799 | A * | 8/1998 | Collins | A45D 1/20 | 211/60.1 |
| 5,979,846 | A * | 11/1999 | Fluhr | B60R 7/14 | 211/64 |
| D701,584 | S * | 3/2014 | Kasbohm | D22/108 | |
| 8,950,596 | B2 * | 2/2015 | Arabian | B60R 7/14 | 211/64 |
| 2013/0269509 | A1 * | 10/2013 | Irwin | F41A 23/005 | 89/37.01 |

* cited by examiner

*Primary Examiner* — Brian Mattei
*Assistant Examiner* — Paola Agudelo
(74) *Attorney, Agent, or Firm* — Harris Beach PLLC

(57) ABSTRACT

A weapon stock saddle for a weapon storage system includes an elongated irregular opening of a weapon stock saddle to receive a butt end of a weapon stock. The elongated irregular opening includes a toe end and a head end. The weapon stock saddle also includes a plurality of substantially parallel adjacent steps. Each step has a different height above a horizontal surface and forms a wall to capture the butt end of the weapon stock. A floor of the elongated irregular opening, between the toe end and a first wall of a first step of the plurality of substantially parallel adjacent steps, has an angle of about 17 degrees plus or minus 10 degrees with respect to a horizontal surface upon which the weapon stock saddle rests.

20 Claims, 13 Drawing Sheets

WEAPON STOCK SADDLE FOR A MASS WEAPON STORAGE SYSTEM

CROSS-REFERENCE TO RELATED APPLICATIONS

This application is a continuation of and claims priority to and the benefit of co-pending U.S. provisional patent application Ser. No. 14/533,806, REVISED MASS WEAPON STORAGE SYSTEM, filed Nov. 5, 2014, which application is incorporated herein by reference in its entirety.

FIELD OF THE APPLICATION

The application relates to the storage of weapons, and particularly to a stock saddle for secure and efficient storage of one or more weapons in a storage cabinet.

BACKGROUND

Weapons storage presents unique challenges. Weapons should be securely fastened and seated in a mass weapon storage system, yet readily accessible for use when needed.

SUMMARY

According to one aspect, a weapon stock saddle for a weapon storage system includes an elongated irregular opening of a weapon stock saddle to receive a butt end of a weapon stock. The elongated irregular opening includes a toe end and a head end. The weapon stock saddle also includes a plurality of substantially parallel adjacent steps. Each step has a different height above a horizontal surface and forms a wall to capture the butt end of the weapon stock. A floor of the elongated irregular opening, between the toe end and a first wall of a first step of the plurality of substantially parallel adjacent steps, has an angle of about 17 degrees plus or minus 10 degrees with respect to a horizontal surface upon which the weapon stock saddle rests.

In one embodiment, a flat portion of each of the steps has an angle from the horizontal surface of about 17 degrees plus or minus 10 degrees.

In another embodiment, a butt end sits in the weapon stock saddle where a longitudinal axis of the weapon has an angle off a vertical axis which is about perpendicular to the horizontal surface by about 17 degrees plus or minus 10 degrees.

In yet another embodiment, the weapon stock saddle further includes at least two interlocking features to join the weapon stock saddle to another weapon stock saddle.

In yet another embodiment, the at least two interlocking features include a capped post interlocking feature on one side of the weapon stock saddle or a capped post opening on another side of the weapon stock saddle.

In yet another embodiment, the capped post includes a beveled edge of a post of the capped post.

In yet another embodiment, the capped post includes a beveled edge of a cap of the capped post.

In yet another embodiment, the elongated irregular opening which receives a butt end of a weapon stock includes a width at the toe end narrower than a width at the head end.

In yet another embodiment, the weapon stock saddle further includes two partial circular or cylindrical cutouts in a top surface of the weapon stock saddle, the two partial circular or cylindrical cutouts configured to receive handles of a weapon.

In yet another embodiment, a first circular or cylindrical cutout of the weapon stock saddle is closer to the horizontal surface than a second circular or cylindrical cutout which is higher than the first partial circular or cylindrical cutouts causing the weapon with handles resting in the weapon stock saddle so that the weapon leans at an angle off vertical of about 17 degrees plus or minus 10 degrees.

In yet another embodiment, the first circular or cylindrical cutout and the second circular or cylindrical cutout of the weapon stock saddle are each sized to receive a hand hold or a handle of a machine gun.

In yet another embodiment, the weapon stock saddle further includes an antiskid feature affixed to a bottom surface of the weapon stock saddle.

In yet another embodiment, the antiskid feature includes a rubber material.

In yet another embodiment, the antiskid feature includes a non-skid mat.

In yet another embodiment, the antiskid feature includes at least one or more feet or strips.

In yet another embodiment, the weapon stock saddle further includes at least one or more transverse support members.

In yet another embodiment, the weapon stock saddle further includes at least one or more longitudinal support members.

In yet another embodiment, the weapon stock saddle includes an a thermoplastic or an acrylonitrile-butadiene-styrene (ABS).

In yet another embodiment, the weapon stock saddle includes an ABS plastic with an olefin additive.

In yet another embodiment, the elongated irregular opening and the plurality of substantially parallel adjacent steps are sized to accept both an AK and an AR type rifle.

The foregoing and other aspects, features, and advantages of the application will become more apparent from the following description and from the claims.

BRIEF DESCRIPTION OF THE DRAWINGS

The features of the application can be better understood with reference to the drawings described below, and the claims. The drawings are not necessarily to scale, emphasis instead generally being placed upon illustrating the principles described herein. In the drawings, like numerals are used to indicate like parts throughout the various views.

DETAILED DESCRIPTION

Definitions

Figure 1:
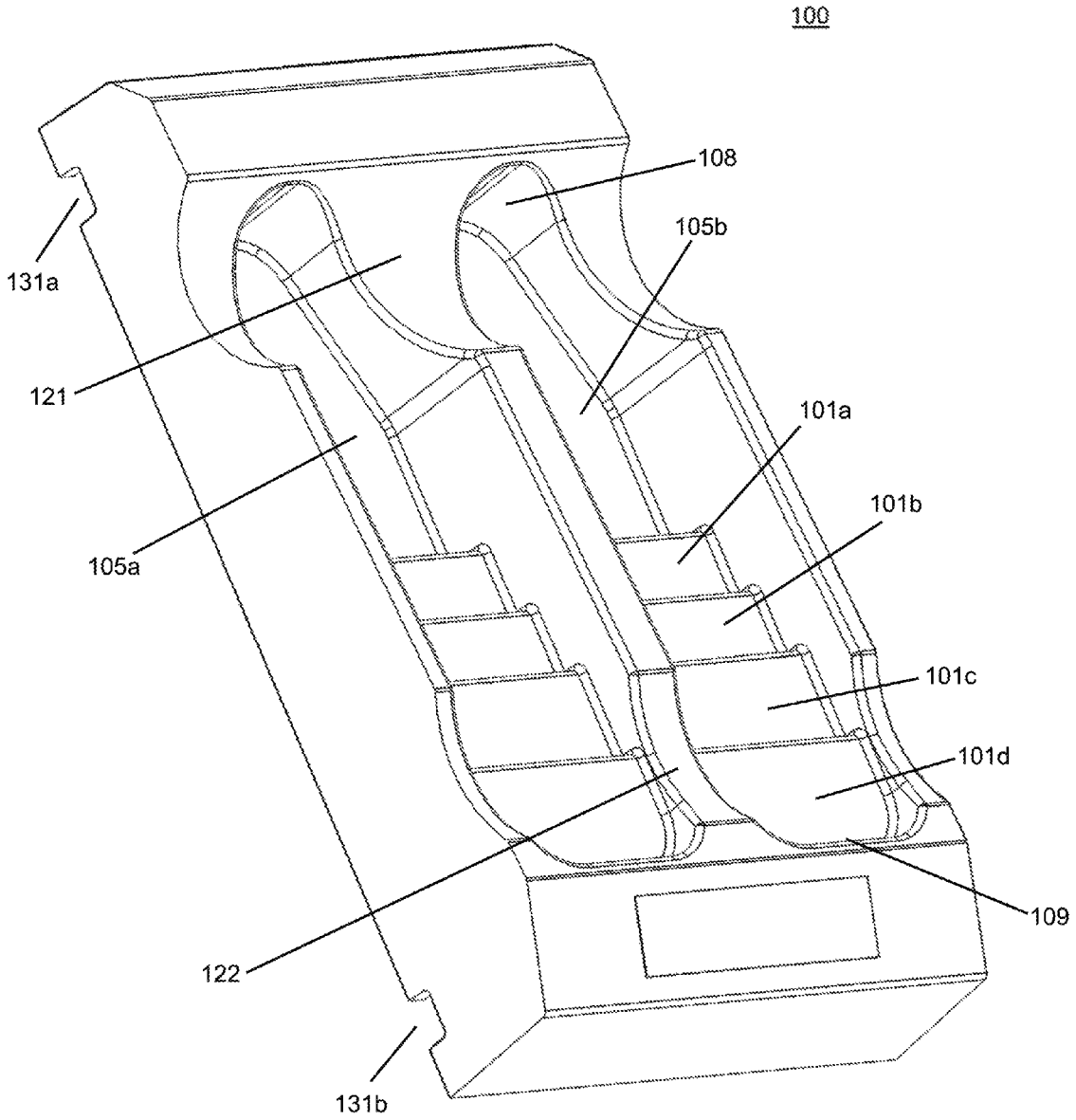
FIG. 1 shows an axonometric view of an exemplary stock saddle.

AR and AK: AR and AK considered abbreviations of types of rifles. AR refers to rifles first designed or manufactured by the ArmaLite Company before about 1959 and their progeny. AK refers to the types of rifles originally designed by Avtomat Kalashnikova circa 1947 and their progeny. AR and AK have for all practical purposes become words in the gun industry and are now well known terms to those skilled in the art.

As described hereinabove, weapons storage presents unique challenges. Weapons should be securely fastened and seated in a mass weapon storage system, yet readily accessible for use when needed. One such mass weapon storage system was described in U.S. Pat. No. 8,678,206, SYSTEM FOR STORAGE AND TRANSPORT OF WEAPONS, issued Mar. 25, 2014 to Kubiniec. The '206 patent is incorporated herein by reference in its entirety for all purposes. A revised mass weapon storage system with novel features over the previous system is now described.

One of the problems in weapons transport is how to keep one or more weapons securely stored in a weapons storage compartment during transport, yet easily accessible for fast deployment. More specifically, and particularly where weapons such as rifles or machine guns are stored vertically in a vehicle, there is chance that the butt end of the stock could come out of the lower butt saddle, such as when the vehicle goes over a bump or pot hole. Airborne transport platforms can suffer the same problem related to severe vibration associated with turbulence or rapid and forceful maneuvering when taking evasive action to avoid incoming ordinance.

Another problem in weapons transport is that while storage compartment upper saddles have been configured to accept a wide variety of firearm receivers, hand grips, and barrels, increasingly organizations are moving towards weapon storage in individual storage bags, such as to retain vapor corrosive inhibiter (VCI) to preserve the weapon condition during storage. These VCI bagged weapons (e.g. weapons in a protective bag) do not fit securely in most current weapon storage compartment or weapon storage rack upper saddles.

What is needed is a revised mass weapon storage system that can better assure that the butt end of the weapon stock will not accidentally come free of a weapon storage compartment stock saddle. Also, there is a need for an upper saddle that can accommodate a weapon stored in a bag, such as a bag with a VCI treated interior.

Generally, the stock saddle (also referred to as a lower saddle), is placed on a horizontal lower shelf which becomes the floor of a weapon storage cabinet, weapon storage locker, weapon storage compartment, weapon storage compartment, or weapon storage transport system. As described hereinbelow in more detail, the stock saddle includes an asymmetrical oval opening adapted to receive a butt end of a weapon. The lower shelf defines a horizontal shelf having a horizontal plane. At least one stock saddle is used, however there can also be two or more stock saddles, such as for example, by interlocking stock saddles one next to the other, side to side. In some embodiments, stock saddles can be coupled to one another by at least two interlocking features on the sides of the stock saddle. The asymmetrical oval opening has a toe end and a longitudinally opposed head end. The dimensions of the butt end of the stock are referred to herein where the height dimension of the butt end of the stock is the long dimension along a rear butt end of the stock corresponding to the longitudinal axis of the stock saddle from the toe end to the head end of the asymmetrical stock opening. The width of the stock is understood to be a transverse measurement or distance across the butt end of the stock corresponding to a direction transverse to the longitudinal direction.

Each stock saddle can have positions for one or more weapon stocks. In most embodiments, the butt end of the stock fits into an opening, such as, for example, an asymmetrical opening in the stock saddle. In some embodiments, weapons with rear hand holds or handles at or behind the butt end of the stock and can be received by corresponding partial circular or partial cylindrical cutouts in the stock saddle.

The detailed description begins with exemplary embodiments of the stock saddle. Generally, there is also at least one upper saddle for each weapon. Following the detailed description of the stock saddle, there is a detailed description of a novel upper saddle having three different sections having three different width openings, the middle opening having an intermediate transition portion.

FIG. 1 shows an axonometric view of one exemplary stock saddle 100, typically a lower saddle, which is part of a new solution to further secure the stock of a weapon in a storage rack, while not impacting the ability of a user to have fast access to the weapon when needed. The exemplary stock saddle is configured to hold one or two stocks in asymmetric oval opening 105*a* and 105*b*. One aspect of the improved stock saddle, typically a lower saddle used for vertical weapon storage, are the series of steps including step 101*a*, 101*b*, 101*c*, and 101*d*. Each step has a wall off vertical from the horizontal plane at a slant angle and flat portion also canted at a slant angle of horizontal by about the same angle that the step wall is off vertical. The slant angle and its purpose are described in more detail hereinbelow. The number of steps, here four, is unimportant. Another improved feature is the asymmetric and somewhat irregular oval openings 105*a* and 105*b*. By a combination of the narrowing of the openings 105*a* and 105*b* from saddle toe 108 to saddle head 109, it was realized that smaller butt ends of stocks characteristic of some types of weapons can be better captured by openings 105*a* and 105*b*. For example, most AK type assault rifles, as well as some of the older Remington rifles have relatively narrow smaller butt ends of the stock. Also, as placed into oval openings 105*a* and 105*b*, Weapons exhibit a wide range of stock height (i.e. how far the butt end of the stock extends in the direction from saddle toe 108 to saddle head 109. Just as, for example, an AK type weapon is narrower from side to side at the butt end of the stock compared with some more modern designs, so are they typically less high. Less high butt ends of smaller stocks might only extend, for example, from the saddle toe end 108 to the rise after step 101*a* or step 101*b*. The vertical wall of the next successive step past the height of the butt end of the stock, when nestled against the saddle toe end 108, forms an opposite wall that helps hold the stock from moving in the stock saddle. The front to rear movement, such as is typically front to rear with respect to a back wall or side wall of weapon storage closet, is thus minimized By better capturing the stock in a narrower portion of the stock saddle opening 105*a* or 105*b* near the saddle toe 108, and/or restricting movement of the butt end of the stock between the saddle toe 108 to saddle head 109, such as by the new steps 101*a* to 101*d*, a weapon is far less likely to depart the stock saddle when a transport vehicle experiences a jarring event, such as, for example, a bump, foreign object in the road, or pot hole. Capped post openings 131*a* and 131*b*, as are described in more detail hereinbelow, form openings or socket for joining stock saddles 100 side by side for a desired number of weapon storage positions. Partially rounded cutout 121 and 122 form openings to receive hand holds from weapons which have one or two handles at the butt stock end, such as for example, the classic U.S. military style 0.55 caliber machine guns suited to be moved to portable mounts for field use, or to be fitting on mounts in aircraft or naval vessels. Another feature improvement for capturing such handled weapons is that the cutout 121 is lower than the cutout 122. With the rounded cutouts at different heights, the weapon can be stored a slight angle off vertical leaning towards an upper saddle and a back or side wall of the weapon storage compartment. This slight angle off vertical has been found to create yet greater stability of transport, by biasing or urging the weapon into one or more upper stocks by the force of gravity.

Figure 2:
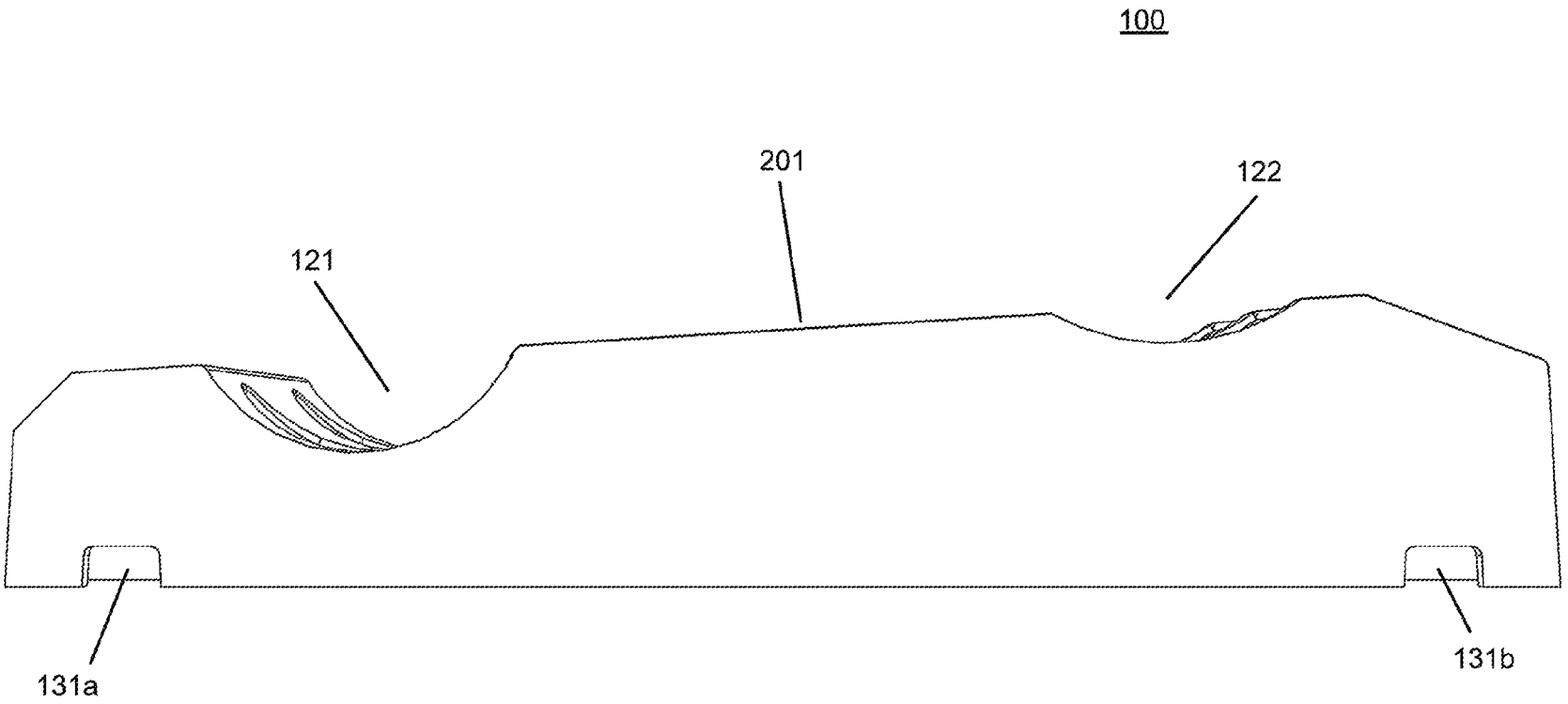
FIG. 2 shows a side view of the exemplary stock saddle of FIG. 1.

FIG. 2 shows a side view of the exemplary stock saddle of FIG. 1. It can be seen that the saddle top surface is canted at an angle of about 17 degrees plus or minus 10 degrees from horizontal. The floor of saddle opening 105*a* or 105*b* from the saddle head 109 to the saddle toe 108 is similarly canted or slanted at an angle of about 17 degrees plus or minus 10 degrees from horizontal. Typically, the horizontal surfaces of each step 101*a* to 101*d* are also similarly canted at an angle of about 17 degrees plus or minus 10 degrees from horizontal. The cant angle or slant angle of, for example, the horizontal surfaces of the steps need not be identical to the cant angle of the floor of saddle opening 105*a* or 105*b* from the vertical surface of the lowest step 101*a* to the saddle toe 108. However, in most embodiments the slopes of the horizontal surfaces of the steps will be about the same as the slope of the floor of the saddle openings 105*a* or 105*b*. The cant angle of about 17 degrees plus or minus 10 degrees from horizontal causes the weapon to similarly lean into one or more upper saddles, using gravity to help secure the weapon more securely against an abrupt vehicle, boat, ship, or aircraft motion.

Figures 3, 4:
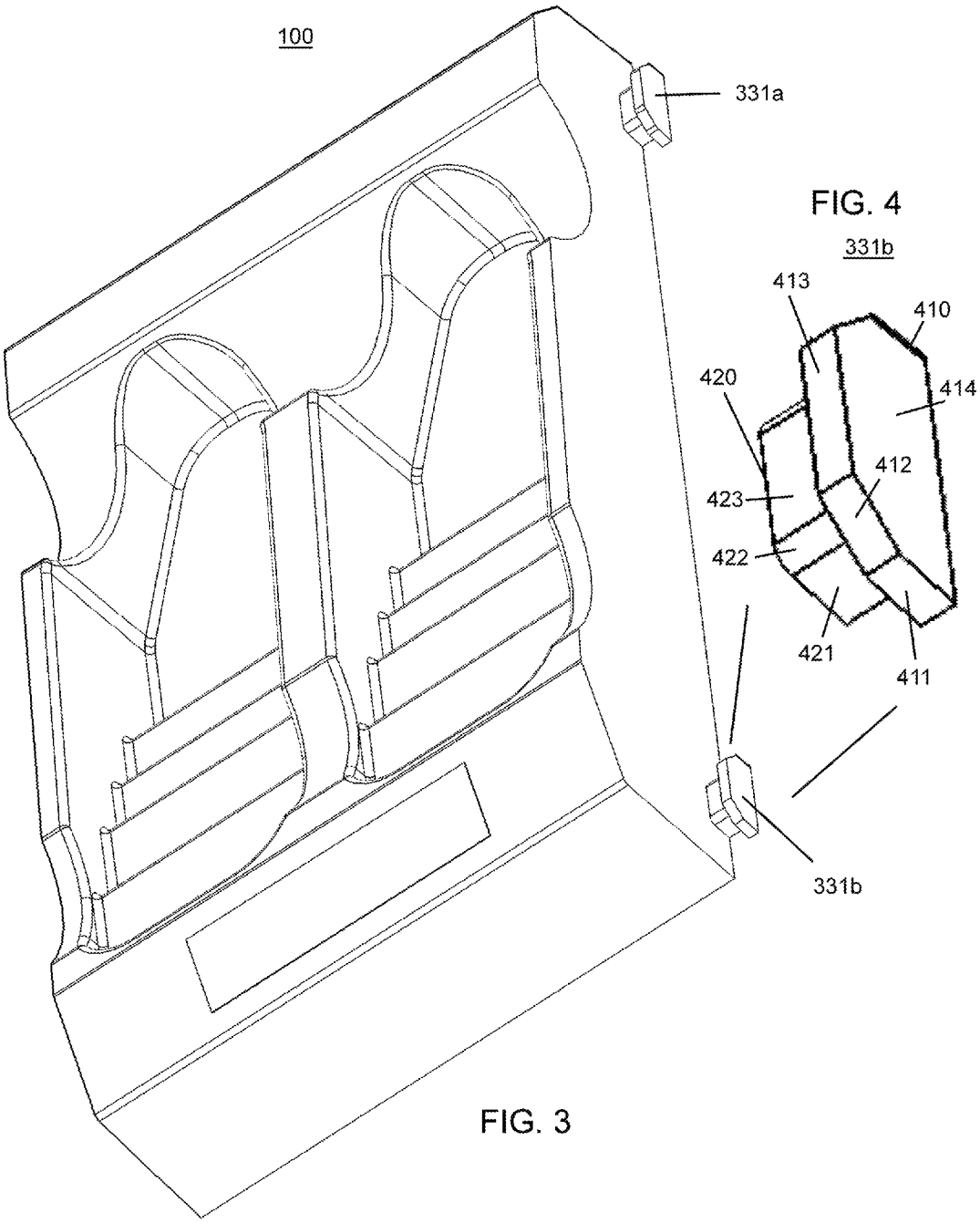
FIG. 3 shows another view of the exemplary stock saddle of FIG. 1.
FIG. 4 shows an exemplary capped post used to join two or more stock saddles together.

FIG. 3 shows another view of the exemplary stock saddle of FIG. 1 looking from what typically is the front part with steps towards what is typically the back side near the toe. In this view, capped post 331*a* and 331*b* can be seen which are used to interlock two or more stock saddles together. Typically two or more capped posts are located on one side of the stock saddle, and two or more corresponding capped post openings are located on the other side of the stock saddle. There could also be end stock saddles with only two capped posts on one side and no capped post openings on the other side of the stock saddle and/or there could be end stock saddles with only two capped post openings on one side and no capped posts on the other side of the stock saddle. To cascade two or more stock saddles together, capped post 331*a* and 331*b* are inserted into corresponding capped post openings 131*a* and 131*b* (FIG. 1).

FIG. 4 shows more detail of one exemplary capped post 331*b*. Exemplary capped post 331*b* includes post 420 and cap 410. Post 410 has side 421, bevel 422, and top 423. Cap 410 includes side 411, bevel 412, top 413, and front face 414.

Figure 5:
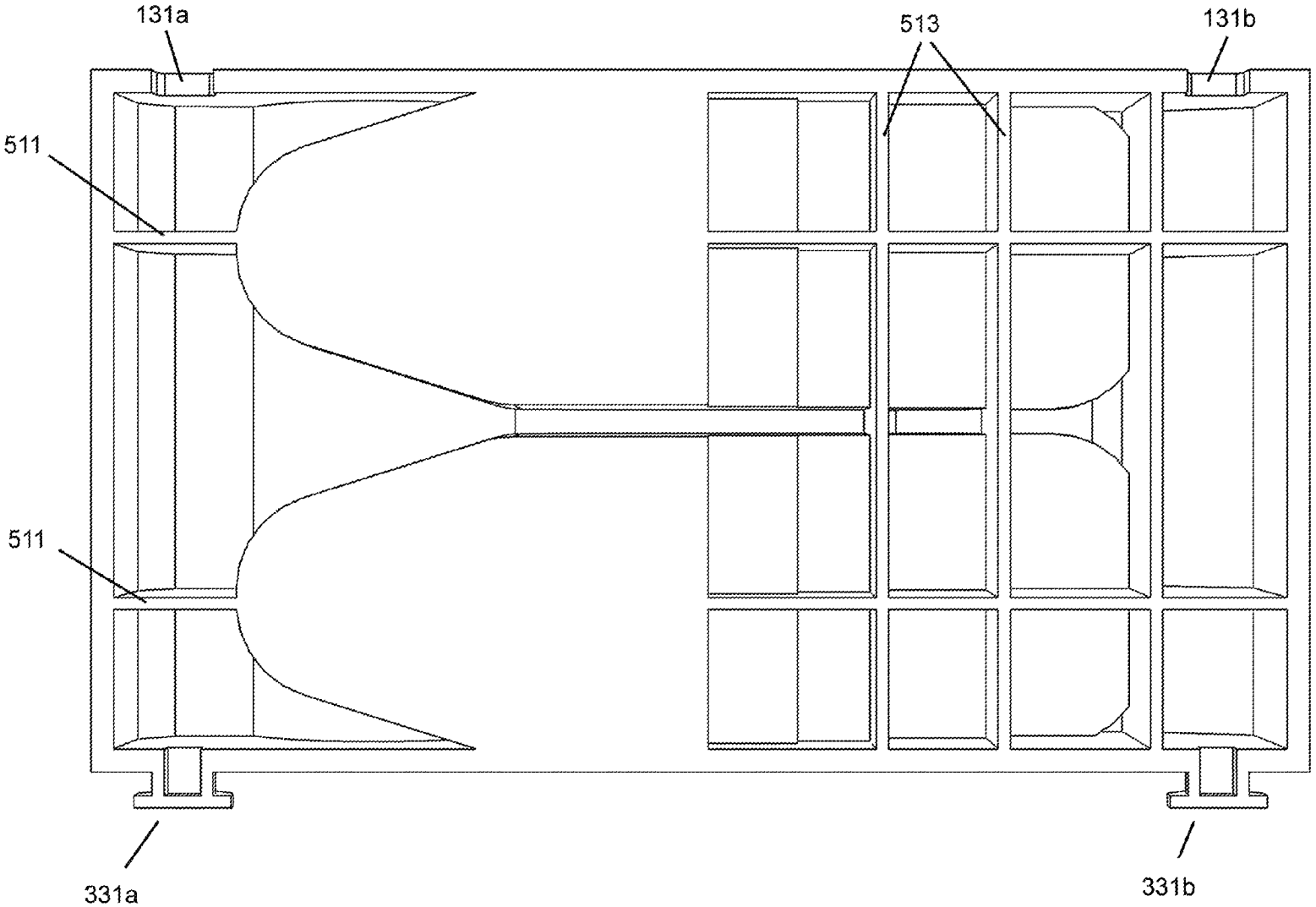
FIG. 5 shows a simplified drawing of the underside of the exemplary stock saddle of FIG. 1.

FIG. 5 shows a simplified drawing of the underside of the exemplary stock saddle of FIG. 1. An antiskid feature can be mechanically attached to the bottom of one or more stock saddles by any suitable means, such as, for example, by glue or adhesive. Non-skid rubber features, such as, for example, a non-skid mat, feet, strips, etc. are not visible in FIG. 5. Such non-skid features can be manufactured from any suitable material, such as, for example, rubber sheet stock. Longitudinal support members 511 and transverse support members 513 can be used to strengthen the stock saddle for supporting heavier weapons and to make the stock saddle more durable over use and time. There can also one or more transverse members.

Figure 6:
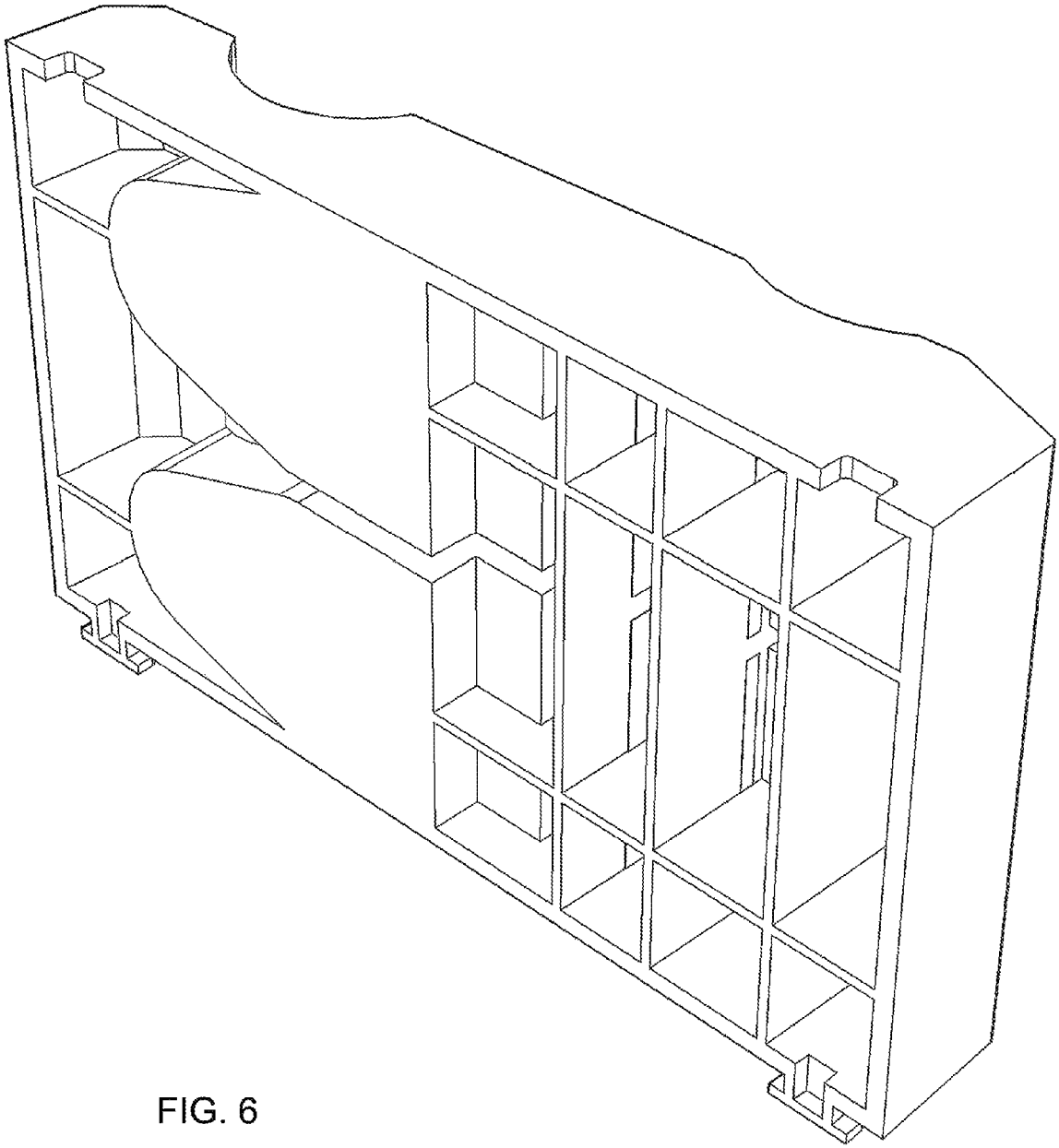
FIG. 6 shows another axonometric view of the underside of the exemplary stock saddle of FIG. 1.

FIG. 6 shows another axonometric view of the underside of the exemplary stock saddle of FIG. 1.

Figure 7:
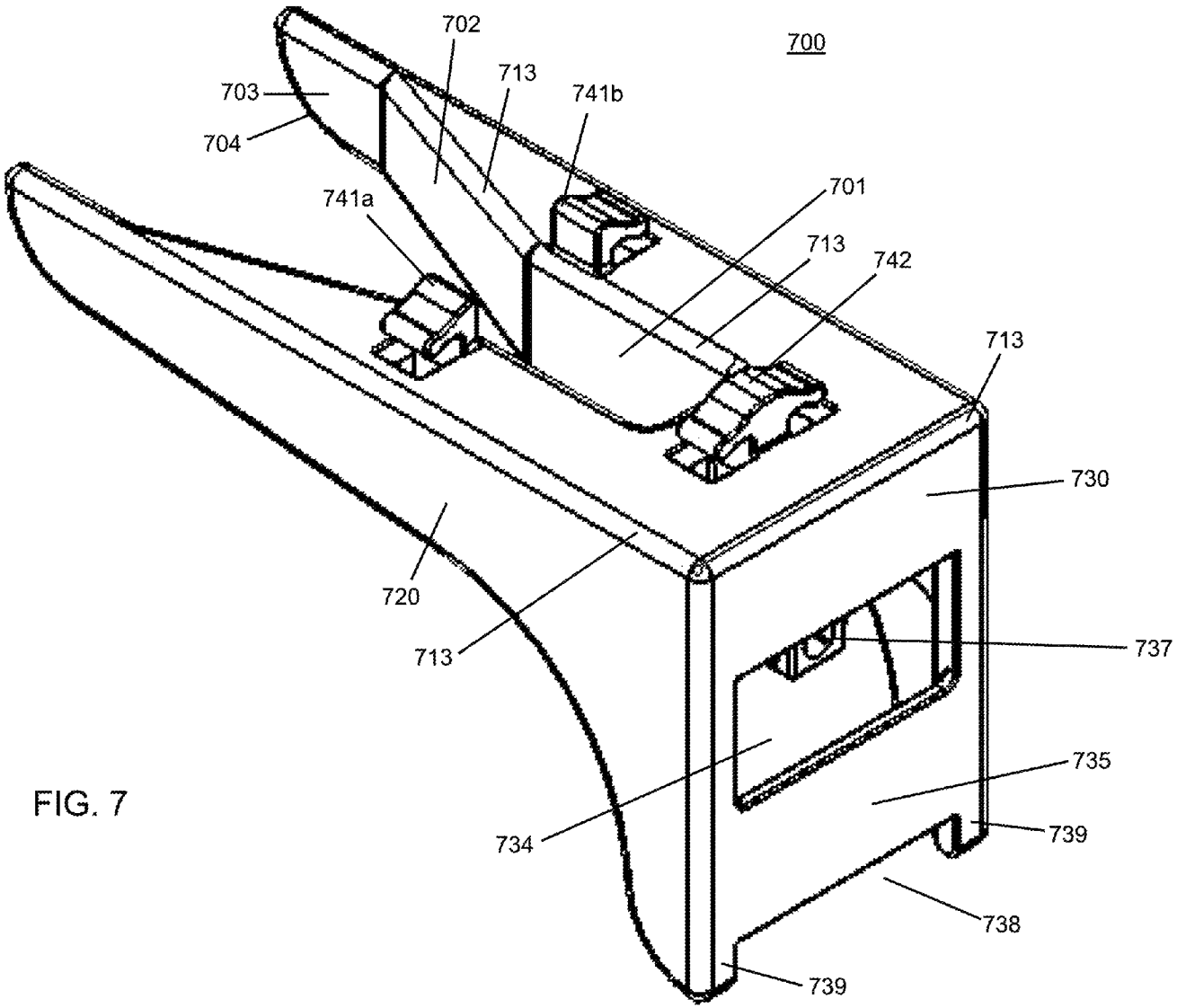
FIG. 7 shows a drawing of one exemplary upper saddle adapted to receive a weapon stored in a bag.

Upper Saddle: FIG. 7 shows a drawing of one exemplary upper saddle 700 adapted for receiving a weapon stored in a bag. In many weapons storage applications, as described hereinabove, one or more weapons in a weapon storage rack can be stored in a bag, such as, for example, a relatively heavy plastic bag filled with a VCI. Bagged weapons have been stored in conventional upper saddles typically designed for that weapon or another weapon's receiver, hand grip, or barrel. Such storage in a smaller upper saddle opening than that the width of the bagged weapon at about the upper saddle position can lead to less secure weapon storage. It was realized that what is needed is a more universal upper saddle adapted to receive an upper portion of a weapon, upper with respect to the butt end of the stock which is placed securely in the stock saddle. One reliable and secure solution was found to be a wide opening defined between opposing surfaces 703, a transition portion defined between transition surfaces 702, and a rectangular opening defined as between opposing surfaces 701 and the back surface 707 (not visible in FIG. 7). Smaller bagged weapons can fit mostly into opening 701. In some cases, a bagged weapon might only fit as far as part way into, or mostly into the transection section defined by transition surfaces 702. The widest opening, the wide opening defined between opposing surfaces 703 assists to guide a bagged weapon quickly and accurately into a proper secure position in the upper saddle. There also can be some weapons which have a wider section at about a height of the upper saddle that would not otherwise fit into the transition section of the upper saddle, however can be captured by the wide opening.

Turning now to the top surface of upper saddle 700, any of the edges of the upper saddle, such as, for example the edges of the top surface can have a bevel such as, for example a rounded bevel 713. The bevel provides a slight relief which can prevent minor scratches, scrapes, and cuts to a user's hands during insertion and removal of one or more weapons from the weapon storage compartment.

Typically each weapon is further secured to the upper saddle by a cord, such as, for example, and elastic cord wrapped around one or more cleats, such as can be placed on top surface of the upper saddle. In the exemplary illustration of FIG. 7, exemplary upper saddle has two cleats with one tang each 741*a*, 741*b*, and one cleat 742 with two tangs. In use, typically an elastic cord is wrapped around one or more cleats and the bagged or un-bagged weapon typically having a part of the upper stock, receiver, hand grip, or barrel part way or most of the way into the upper saddle, as described hereinabove.

The back surface 730 of upper saddle 700 is typically affixed to a back wall or side wall of a weapon storage compartment. In some embodiments, such as shown in FIG. 7, a captive threaded component (e.g. a threaded metal cylinder insert), such as a PEM™ nut is installed into the upper saddle with its face about co-planar with the back surface 730 and a bolt can be inserted through the wall to secure the upper saddle to the wall. In such mounting configurations, there can be pre-drilled a plurality of holes in one or more rows and/or columns to provide for a plurality of upper saddle mounting locations on the wall of the weapon storage compartment. An alternative embodiment would be to use one or more through holes in the back surface 730 of the upper saddle and to have a threaded hole means in or behind the wall. However, with PEM™ nuts permanently mounted in the holes in the walls (as opposed to loose nuts or loose nuts and lock washers), it can be more cost effective to provide the threaded hole means (e.g. PEM™ nut) in the saddle, rather than to provide tens of PEM™ nuts permanently installed in the walls of the storage compartment. Opening 734 allows access for the threaded means or mounting hole as well as minimized material reducing total storage compartment weight (e.g. for aviation transportation applications as well as for cost efficiency), using less material to manufacture each saddle. Lower back surface 735 strengthens the back as well as posts 739.

Figure 8:
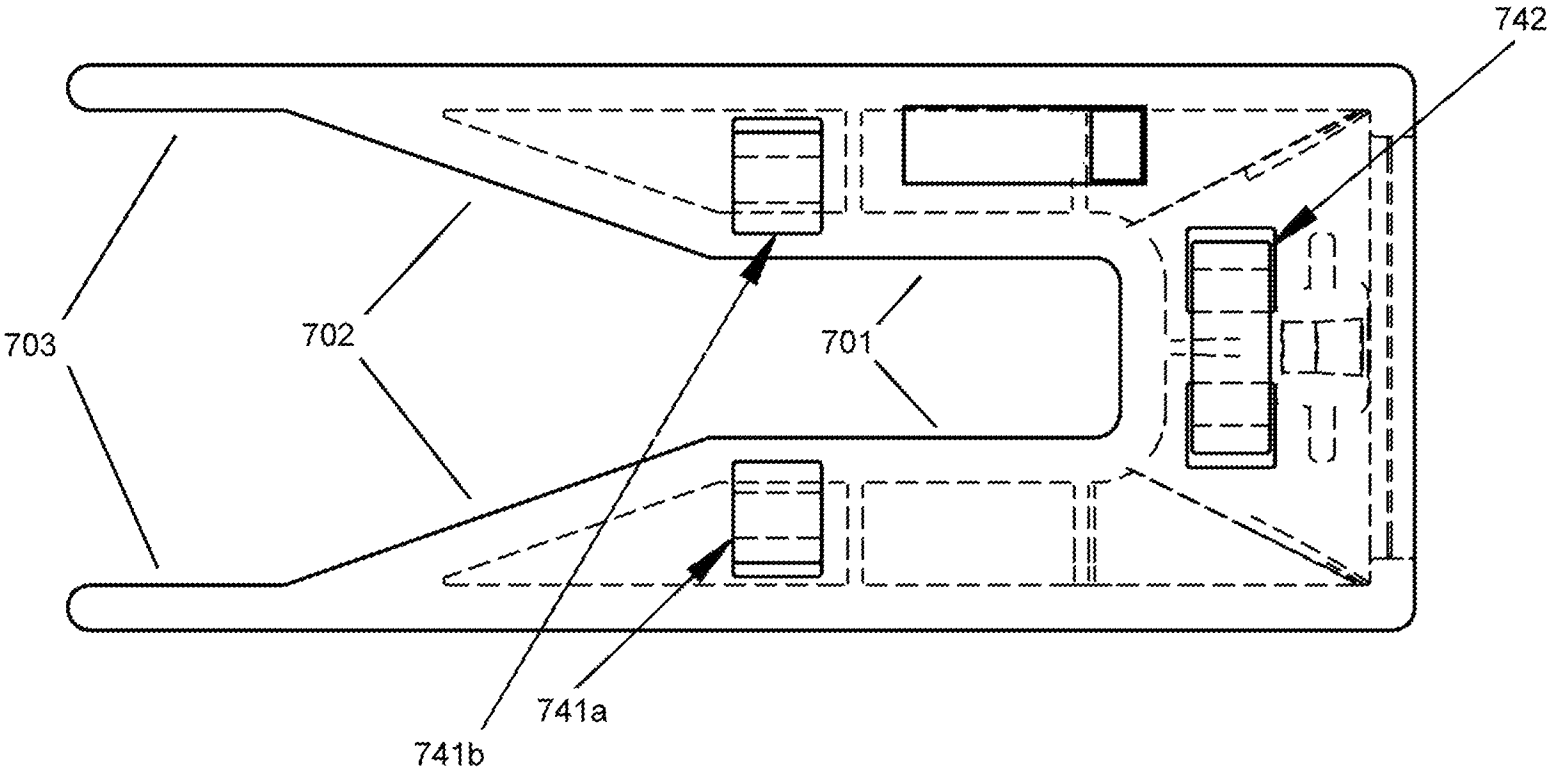
FIG. 8 shows a top view of the exemplary upper saddle of FIG. 7.

FIG. 8 shows a top view of the exemplary upper saddle of FIG. 7. The wide opening between surfaces 703, the transition opening between transition surfaces 702, and the rectangular opening defined as between opposing surfaces 701 can be seen in more detail in FIG. 8.

Figure 9:
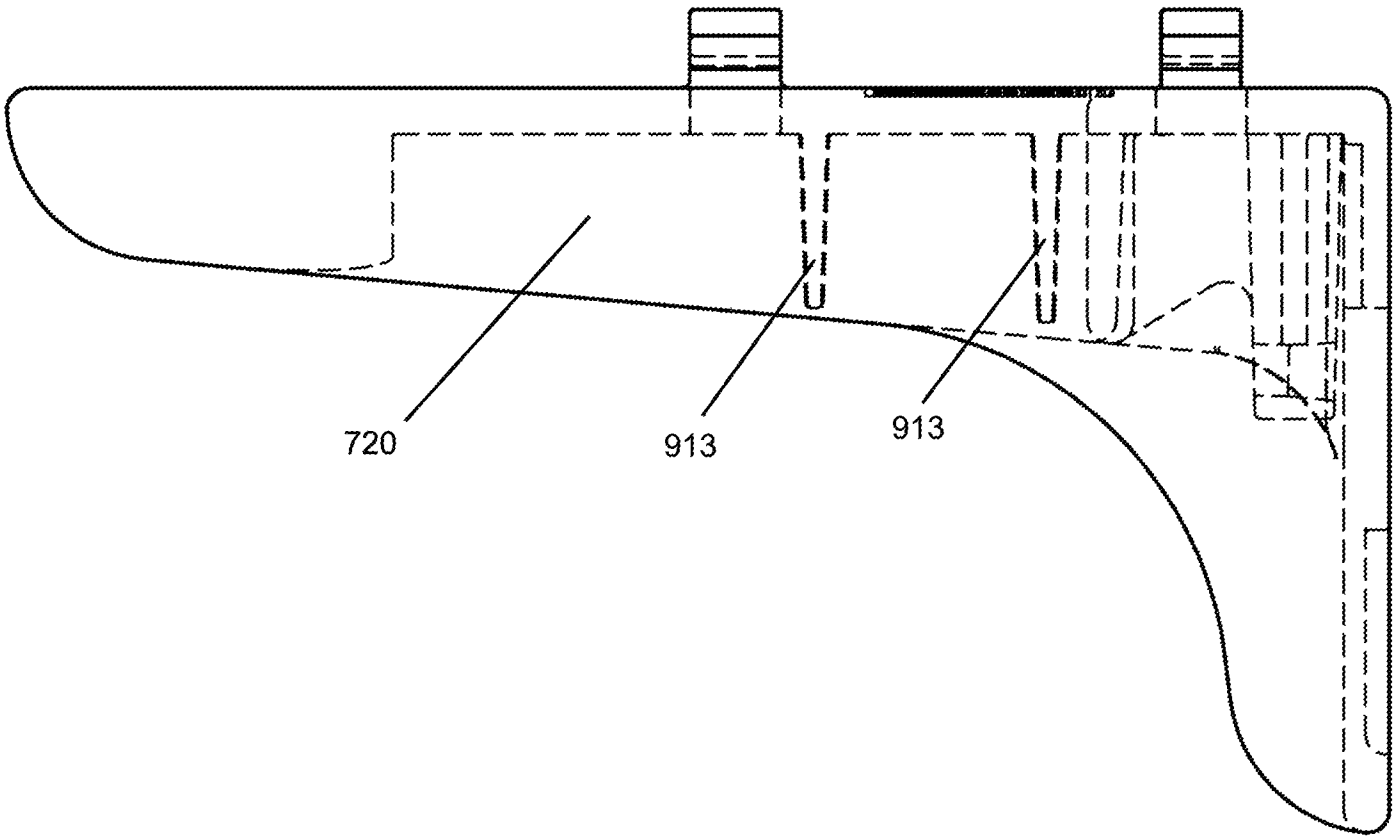
FIG. 9 shows a side view of the exemplary upper saddle of FIG. 7.

FIG. 9 shows a side view of the exemplary upper saddle of FIG. 7. The dotted lines of features 913 show lateral support members (behind side surface 720) which can be used strengthen the upper saddle.

Figure 10:
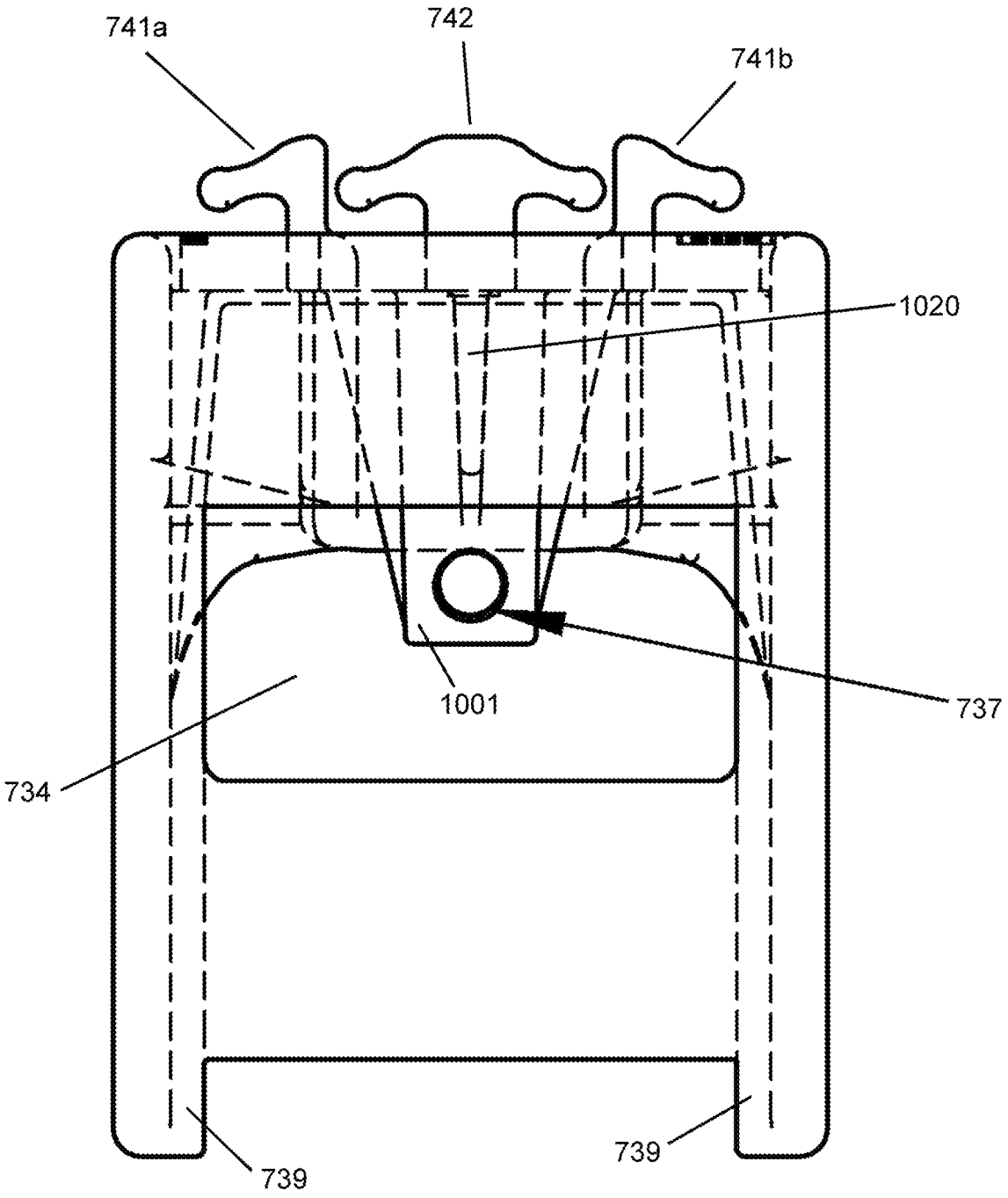
FIG. 10 shows a rear view of the exemplary upper saddle of FIG. 7.

FIG. 10 shows a rear view of the exemplary upper saddle of FIG. 7. In the exemplary embodiment of FIG. 7, PEM™ nut 737 is mounted on a pedestal 1001 and is accessible to receive a threaded bolt through opening 734. Dashed lines 1020 indicate internal support members, such as, for example longitudinal support member 1020.

The stock saddle and/or the upper saddle can be manufactured from any suitable material using any suitable machining or molding process. Typically the saddles are made from a thermoplastic or an acrylonitrile-butadiene-styrene (ABS), such as, for example, an ABS with an olefin additive. Plastics are desirable because of their relatively light weight, durability, and resistance to scratching or marring the surfaces of the weapons. For some specialized applications, the saddles can be made from any suitable metal (e.g. aluminum, brass, steel, or titanium) or wood. Specialized applications range from high strength for a relatively heavy or large weapon to decorative applications for show or ceremony.

The stock saddle and/or the upper saddle can include support members such as strengthening ribs or support members. There can be one or more transverse, longitudinal, diagonal, or curved support members. Typically a support member is formed from the same material, however, more than one material can be used. For example, a saddle moulded from a plastic can have a metal support member, such as a metal section slid into two slots or bolted to the underside of a saddle.

Figure 11:
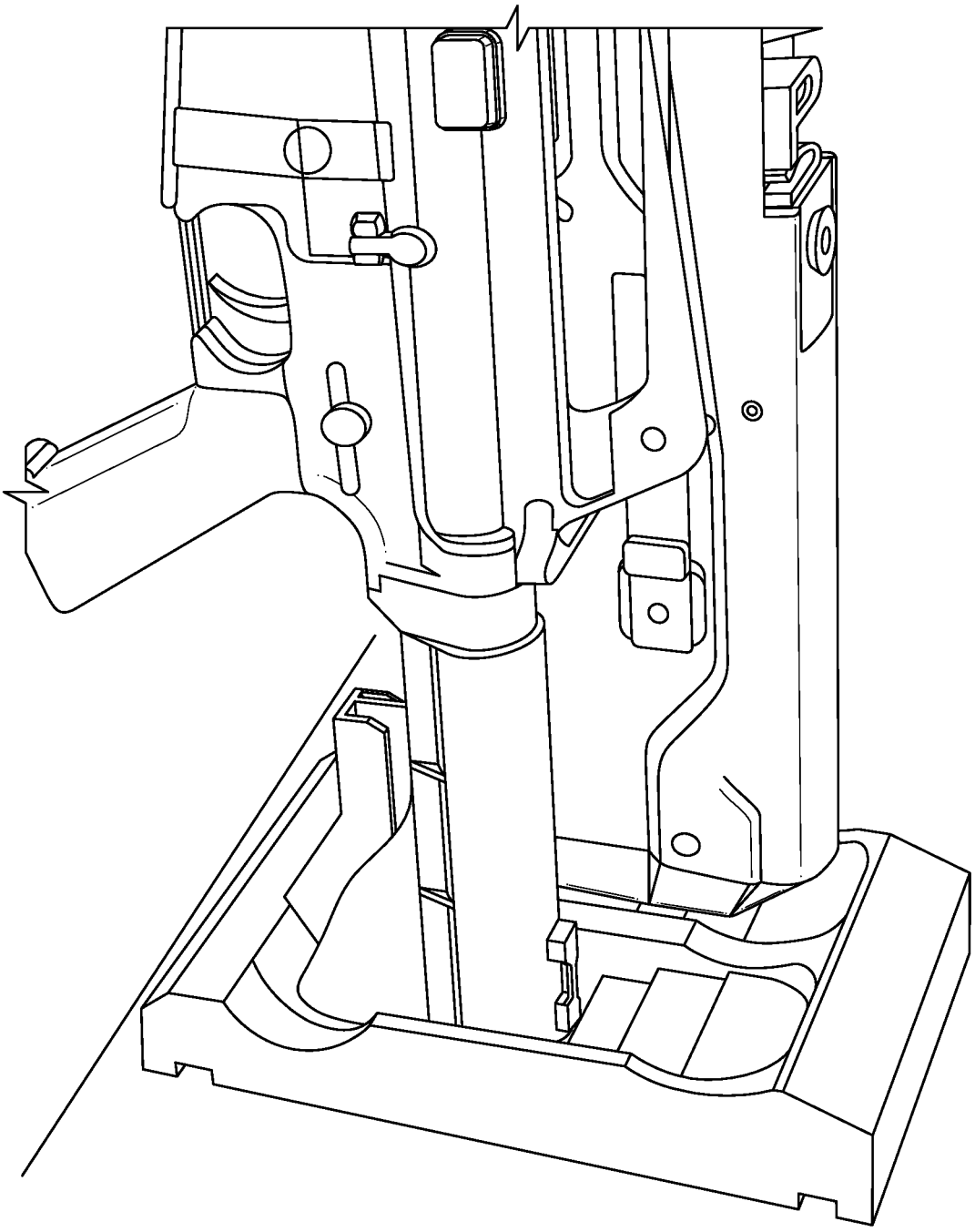
FIG. 11 shows the butt stock of an AR type weapon and a TAVOR IDF type weapon placed in a stock saddle of the type of FIG. 1.

Examples: FIG. 11 shows the butt stock of an AR type weapon and a TAVOR IDF type weapon placed side by side in a stock saddle similar to the stock saddle of FIG. 1.

Figure 12:
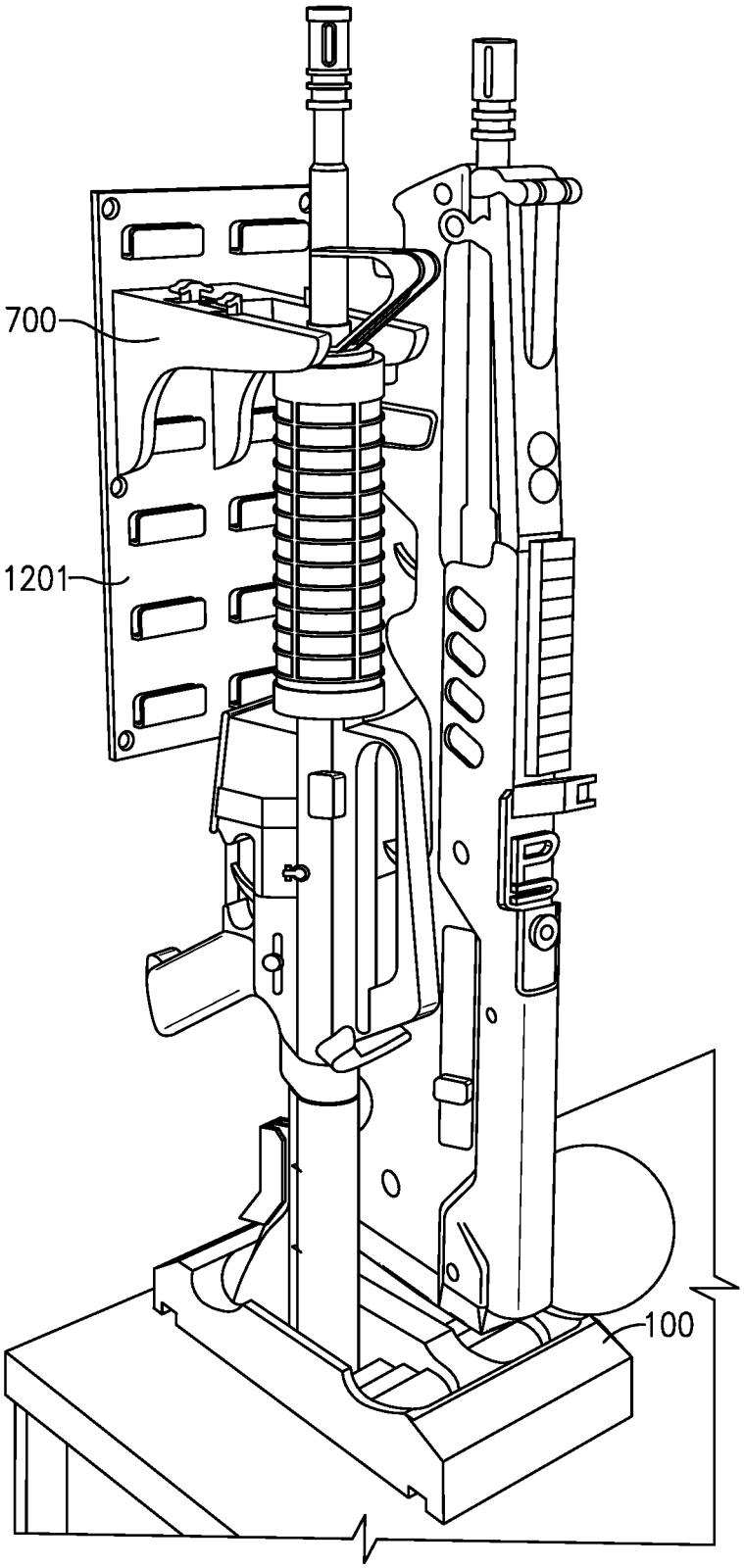
FIG. 12 shows the butt stock of the AR type weapon and the TAVOR IDF type weapon of FIG. 10 placed in a stock saddle and an upper saddle according to FIG. 7.

FIG. 12 shows the butt stock of the AR type weapon and a TAVOR IDF type weapon of FIG. 10 placed in a stock saddle and an upper saddle according to FIG. 7. In the exemplary configuration of FIG. 12, upper saddle 700 is slid over a position of louvered back panel 1201. The back surface 730 of upper saddle 700 can be seen slid over a louver to affix the upper saddle 700 to the louvered back panel 1201. In some embodiments there can also be a locking mechanism such as a threaded bolt lock upper saddle 700 in its place on the louvered back panel 1201.

Stock saddle 100 is as described hereinabove. Notice how the shorter or narrower butt stock of the AR type rifle is held in place by the wall of a lower step than the much wider or taller butt stock of the TAVOR IDF 16.

Figure 13:
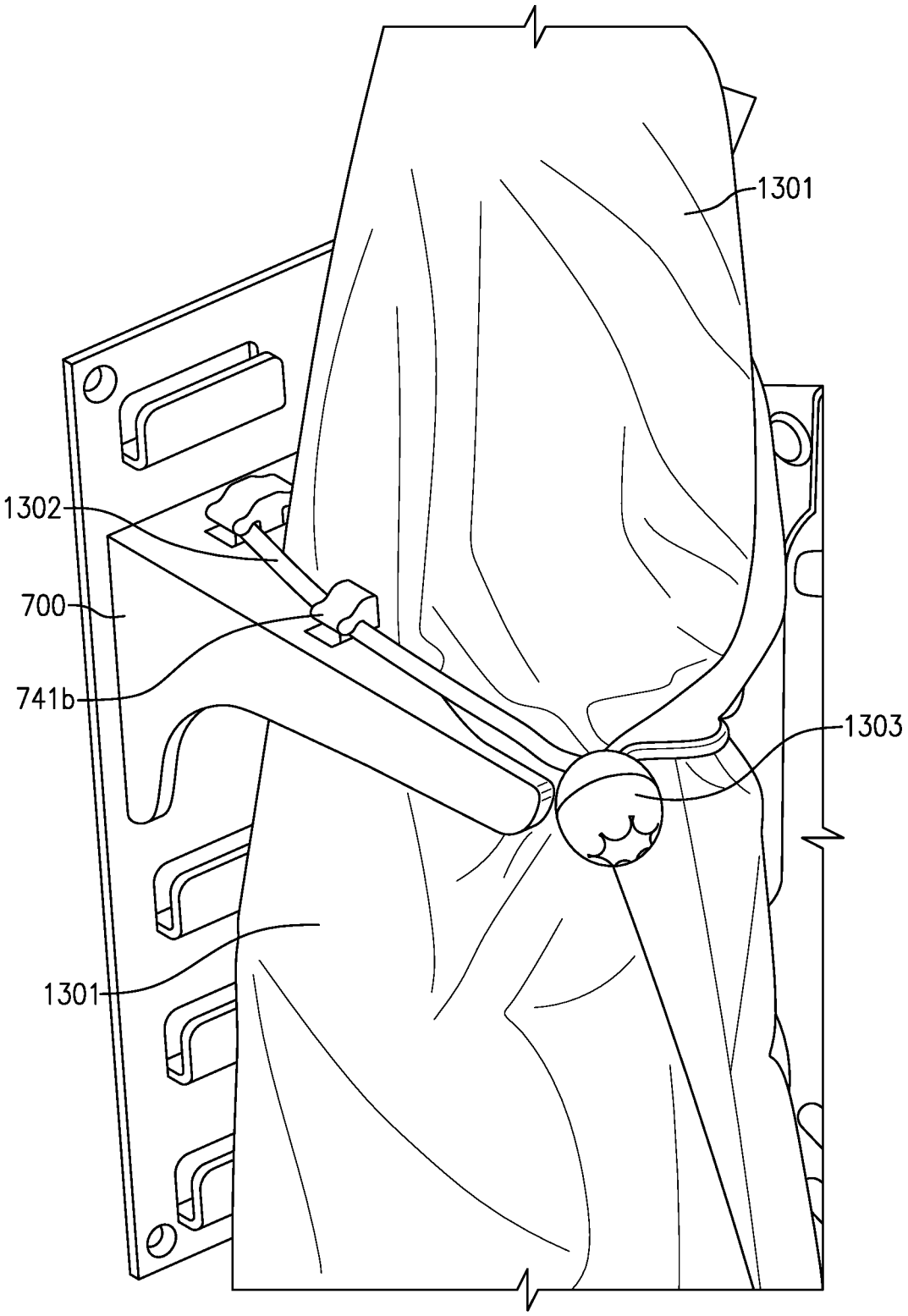
FIG. 13 shows a bagged rifle stowed in an upper saddle according FIG. 7.

FIG. 13 shows a bagged rifle 1301 stowed in an upper saddle according FIG. 7. The upper portion of the bagged rifle 1301 is secured in the openings of upper saddle 700 and held in place by an elastic cord 1302 by exemplary upwardly-extending cleats 741*a*, 741*b*, and 742, each having one or more outwardly-extending tangs. Graspable bead 1303 facilitates rapid removal of the elastic cord 1302 for quick access to the weapon when needed.

Figure 14:
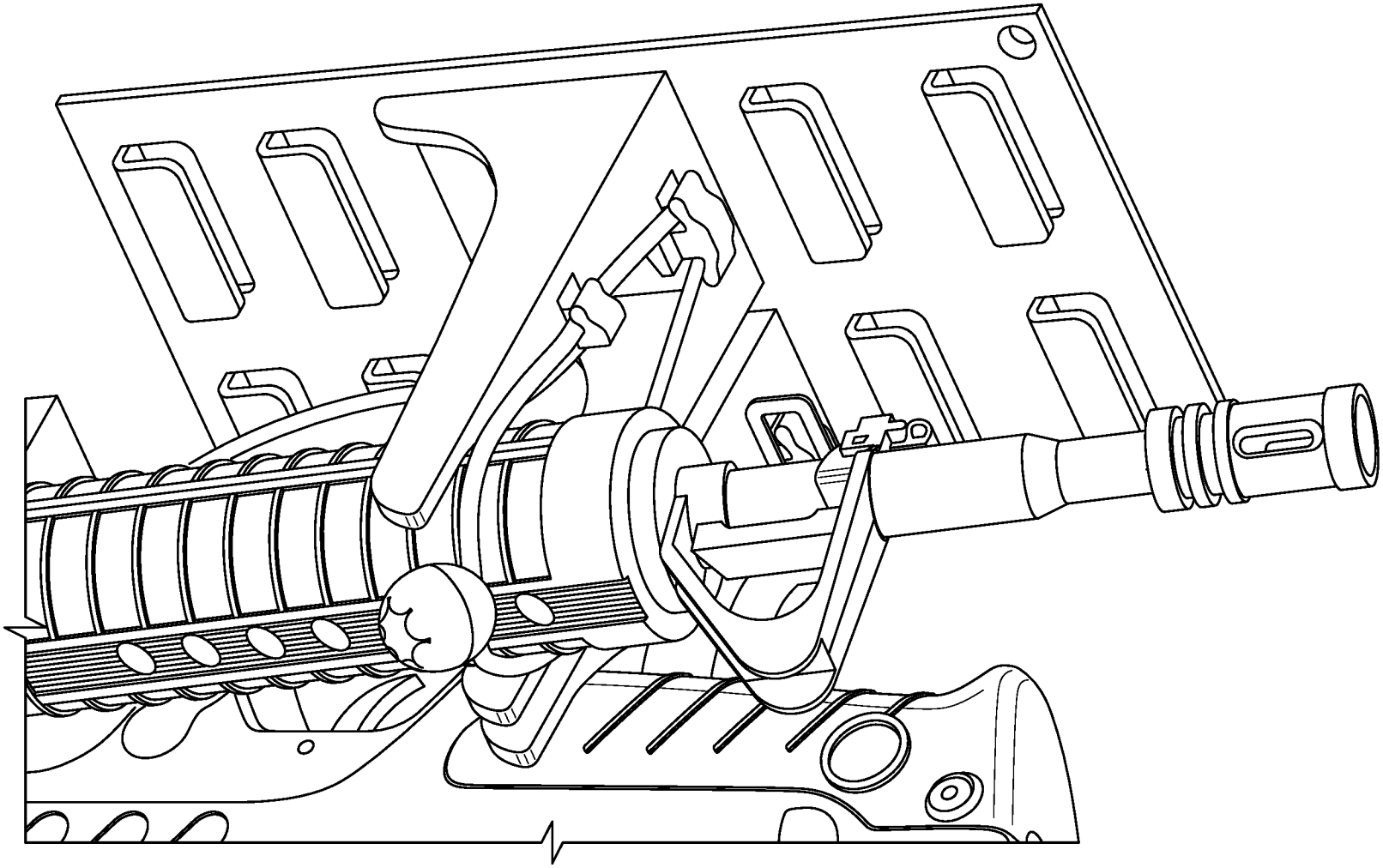
FIG. 14 shows a hand hold of an AR type weapon and the hand hold of a TAVOR IDF type weapon placed in an upper saddle according to FIG. 7.

FIG. 14 shows a hand hold of an AR type weapon and the hand hold of a TAVOR IDF type weapon placed in two separate upper saddles according to FIG. 7. The two upper saddles are shown mounted side by side on a louvered back panel.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A weapon stock saddle for a weapon storage system comprising:

an elongated irregular opening of a weapon stock saddle to receive a butt end of a weapon stock, said elongated irregular opening comprising:
a toe end; and
a head end;

a plurality of substantially parallel adjacent steps, each step having a different height above a horizontal surface and forming a wall to capture the butt end of the weapon stock; and a floor of said elongated irregular opening between said toe end and a first wall of a first step of said plurality of substantially parallel adjacent steps, having an angle of about 17 degrees plus or minus 10 degrees with respect to a horizontal surface upon which said weapon stock saddle rests.

2. The weapon stock saddle of claim 1, wherein a flat portion of each of said steps has an angle from said horizontal surface of about 17 degrees plus or minus 10 degrees.

3. The weapon stock saddle of claim 1, wherein the butt end of the weapon stock sits in said weapon stock saddle wherein a longitudinal axis of the weapon has an angle off a vertical axis which is about perpendicular to said horizontal surface by about 17 degrees plus or minus 10 degrees.

4. The weapon stock saddle of claim 1, wherein said weapon stock saddle further includes at least two interlocking features to join said weapon stock saddle to another weapon stock saddle.

5. The weapon stock saddle of claim 4, wherein said at least two interlocking features comprise a capped post interlocking feature on one side of said weapon stock saddle or a capped post opening on another side of said weapon stock saddle.

6. The weapon stock saddle of claim 5, wherein said capped post comprises a beveled edge of a post of said capped post.

7. The weapon stock saddle of claim 5, wherein said capped post comprises a beveled edge of a cap of said capped post.

8. The weapon stock saddle of claim 1, wherein said elongated irregular opening which receives the butt end of the weapon stock comprises a width at said toe end narrower than a width at said head end.

9. The weapon stock saddle of claim 1, wherein said weapon stock saddle further comprises two partial circular or cylindrical cutouts in a top surface of said weapon stock saddle, said two partial circular or cylindrical cutouts configured to receive handles of a weapon.

10. The weapon stock saddle of claim 9, wherein a first circular or cylindrical cutout of said weapon stock saddle is closer to said horizontal surface than a second circular or cylindrical cutout which is higher than said first partial circular or cylindrical cutouts causing said weapon with handles resting in said weapon stock saddle so that said weapon leans at an angle off vertical of about 17 degrees plus or minus 10 degrees.

11. The weapon stock saddle of claim 10, wherein said first circular or cylindrical cutout and said second circular or cylindrical cutout of said weapon stock saddle are each sized to receive a hand hold or a handle of a machine gun.

12. The weapon stock saddle of claim 1, wherein said weapon stock saddle further comprises an antiskid feature affixed to a bottom surface of said weapon stock saddle.

13. The weapon stock saddle of claim 12, wherein said antiskid feature comprises a rubber material.

14. The weapon stock saddle of claim 12, wherein said antiskid feature comprises a non-skid mat.

15. The weapon stock saddle of claim 12, wherein said antiskid feature comprises at least one or more feet or strips.

16. The weapon stock saddle of claim 1, wherein said weapon stock saddle further comprises at least one or more transverse support members.

17. The weapon stock saddle of claim 1, wherein said weapon stock saddle further comprises at least one or more longitudinal support members.

18. The weapon stock saddle of claim 1, wherein said weapon stock saddle comprises a thermoplastic or an acrylonitrile-butadiene-styrene (ABS).

19. The weapon stock saddle of claim 18, wherein said weapon stock saddle comprises an ABS plastic with an olefin additive.

20. The weapon stock saddle of claim 1, wherein said elongated irregular opening and said plurality of substantially parallel adjacent steps are sized to accept both an AK and an AR type rifle.

* * * * *